United States Patent [19]

Toeppen

[11] 4,450,973

[45] May 29, 1984

[54] CLOSURE FOR PRESSURIZED CONTAINERS

[76] Inventor: Thurston Toeppen, Lois La., R.D. 3, Poughkeepsie, N.Y. 12603

[21] Appl. No.: 425,758

[22] Filed: Sep. 28, 1982

[51] Int. Cl.[3] ..... B65D 53/00

[52] U.S. Cl. ..... 215/329; 215/344; 215/DIG. 1

[58] Field of Search ..... 215/344, DIG. 1, 329

[56] References Cited

U.S. PATENT DOCUMENTS

| | | | |
|---|---|---|---|
| 3,203,571 | 8/1965 | Plunkett | 215/344 |
| 4,061,240 | 12/1977 | Brownbill | 215/344 X |
| 4,089,463 | 5/1978 | Babiol | 215/DIG. 1 |
| 4,196,818 | 4/1980 | Brownbill | 215/344 X |

FOREIGN PATENT DOCUMENTS 788148 12/1957 United Kingdom .

*Primary Examiner*—Donald F. Norton

*Attorney, Agent, or Firm*—Kane, Dalsimer, Kane, Sullivan & Kurucz

[57] ABSTRACT

A screw-type linerless closure molded of resilient plastic is provided with a novel combination of sealing elements for accommodating storage overloads, large container tolerances and variable surface textures, to secure reliable sealing over a wide range of conditions. Operation of the principal sealing ridge is assisted by an adjacent pressure-relief groove, or grooves, and by separate overload-resisting elements. A supplementary sealing flange is also provided to accommodate irregularities of the mating surface of the container.

4 Claims, 4 Drawing Figures

CLOSURE FOR PRESSURIZED CONTAINERS

BACKGROUND OF THE INVENTION

The present invention is directed to a linerless, threaded, molded plastic closure, particularly intended for use with glass bottles containing pressurized liquids, but also suitable for use with other types of containers and for non-pressurized applications.

The carbonated-beverage industry produces large amounts of a bulky product in which the container package must meet severe performance requirements while representing a relatively large percentage of the total product cost. Under these conditions, there is an evident need for container closures which are highly efficient and at the same time economical.

SUMMARY OF THE INVENTION

The invention described herein comprises a screw-type, linerless closure for use with threaded containers, molded from polythylene, polypropylene, or other resilient plastic materials suited to the particular application. The use of resilient plastic makes it inherently resistant to shock and abrasion, and as a one-piece molded closure it can be economically fabricated and conveniently recycled. Specific design features as described below are provided to secure high sealing efficiency over a wide range of storage and handling conditions, and to assure safety and conveneince for the user.

In order to accommodate the wide range of dimensional tolerances and surface finishes associated with glass containers, the subject closure employs sealing elements which bear primarily on the top rim of the container outlet. A substantially conical sealing flange of conventional design, depending from the underside of the crown, is deflected into a shape which adjusts itself to fit that surface. Novel supplementary sealing elements cooperate with the flange member to perform specialized functions in the overall sealing system, as described below in detail.

The structure of the internal thread of the closure may also contribute to the efficiency of the sealing action, by utilizing the compensated-pitch principle described in my U.S. Pat. No. 4,294,370 entitled "Thread Construction for Plastic Closures".

An object of the invention is to provide an improved closure for use on a variety of threaded containers.

Another object of the invention is to provide an improved linerless, molded plastic closure which is suitable for use with containers holding pressurized liquids, and which is adapted to the special characteristics of glass containers.

DESCRIPTION OF THE PREFERRED EMBODIMENT

Figure 1:
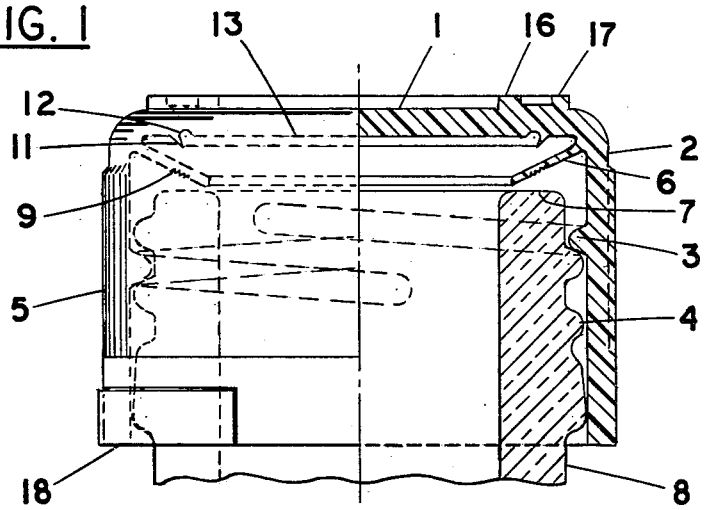
FIG. 1 is an enlarged side view, partially sectioned on the central plane of a closure according to the invention, showing the closure partially installed on a container but prior to sealing contact.

As shown in FIG. 1, the invention is embodied in a molded plastic, screw-type closure made of polyethethylene, polypropylene, or a similar resilient plastic. The basic structure of the closure comprises a circular crown 1, a concentric cylindrical sidewall or skirt 2 which is integral with the crown, an internal screw thread 3 for mating with a container thread 4, and external knurls or flutes 5 by which the closure may be gripped to rotate it on to or off of the container thread.

Depending from the junction of crown 1 and sidewall 2 is a sealing flange 6 in the form of a truncated cone, having an inside diameter which is approximately the same as that of the top surface or rim 7 of container 8, after installation.

Figure 3:
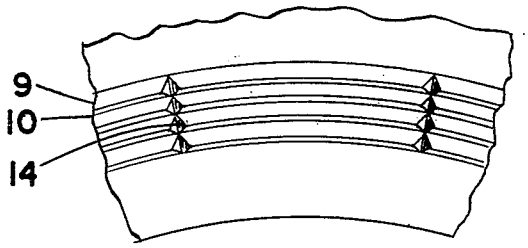
FIG. 3 is a more detailed view of a portion of the underside of the sealing cone of FIG. 1, as viewed from below.

Molded into the under surface of seal 6 is a series of small concentric grooves 9. As shown enlarged in FIG. 3, these are separated by sharp-edged ridges 10 which supplement the operation of seal 6 in a manner to be described. As shown in FIG. 3, the crests of the ridges coincide with the under-surface of seal 6; however, they may also be positioned slightly above or below the surface.

Also depending from crown 1, and concentric with it, is a sealing ridge 11, the effective diameter of the ridge crest being substantially equal to the mean diameter of container top surface 7. Immediately inside or outside of the ridge is a groove 12, the inside location being shown in FIG. 1. The crest of ridge 11 projects below the adjacent plane of the undersurface 13 of crown 1, and groove 12 is recessed into the body of crown 1, so that the volume of ridge 11 below plane 13 is substantially equal to the volume of groove 12 above the plane. The crest of ridge 11 is substantially sharp as molded, whereas the contour of groove 12 is preferably rounded to minimize tension stresses under load. Directly above ridge 11 and groove 12 are a pair of concentric ridges 16 and 17 which are integral with the upper surface of crown 1; the outside diameter of ridge 16 is equal to, or slightly less than, the minimum diameter of groove 12, while the inside diameter of ridge 17 is equal to, or slightly greater than, the maximum diameter of the base of ridge 11, for reasons to be described.

It is contemplated that thread 3 may incorporate the compensated-pitch principle described in my U.S. Pat. No. 4,294,370, previously cited, in order to more effectively equalize thread loading and sealing pressure around the circumference of the closure.

Figure 2:
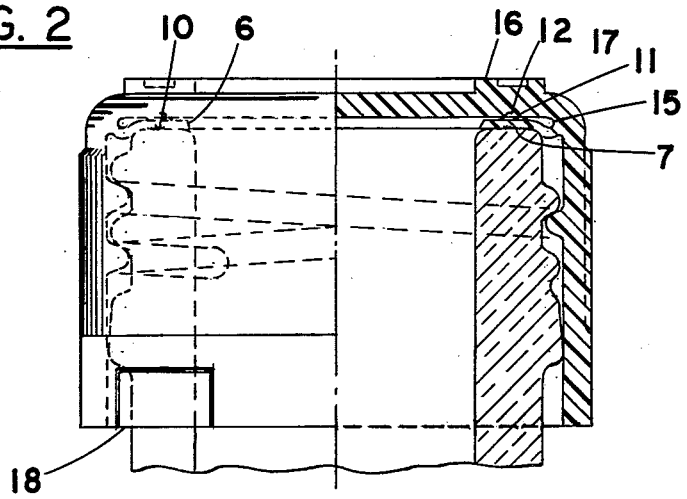
FIG. 2 is a similar sectional side view, the same as FIG. 1 except that the closure has been screwed down firmly onto the container so that the seals are fully deflected and the threads fully loaded.

As the closure is screwed on to the container, seal 6 is deflected toward crown 1 until it is compressed between ridge 11 and surface 7 as shown in FIG. 2. During the final stage of tightening, the crest of the ridge applies the axial closing force developed by the screw threads to a narrow zone on the upper surface of the seal, and through it to multiple ridges 10 and surface 7. At the same time, the axial force deflects part of the material of ridge 11 into groove 12, as provided for by the designed volumes of the ridge and groove and in accordance with the resilience of the molding material used.

Although surface 7 is normally made to be as smooth as glass technology permits, it typically possesses more small asperities and larger irregularities than, for example, a molded plastic surface. The small multiple ridges 10, each of which has one-third or less of the volume of ridge 11, are designed to absorb and to fill in the smallest of these asperities. Because the contour of surface 7 may vary from one lot of containers to another, and because the deflection of seal 6 over surface 7 may affect the final position of ridges 10 with respect to ridge 11, it is desirable to provide multiple concentric ridges 10, as shown in FIG. 3, so that one or two of them are sure to be directly underneath ridge 11 and will therefore be deformed into intimate contact with surface 7. It may also be desirable to mold a series of short radial ridges 14 across ridges 10, and of the same height, in order to divide the grooves 9 into compartments, as shown in FIG. 3. This will minimize leakage in case surface 7 should be even more irregular than normal, or if the deflection of seal 6 should introduce any irregularity into the concentricity of ridges 10 with respect to ridge 11.

In addition to supporting multiple ridges 10, seal 6 performs sealing functions of its own. Its flexibility allows it to adapt to larger variations in the contour of surface 7, and any leakage of internal gas pressure into space 15 above seal 6 will increase the axial sealing force on surface 7. This action is of particular value while the closure is in the process of recovering from abnormal top-load pressures, as detailed below.

The primary axial sealing pressure is applied through ridge 11, which is designed to be pliable enough to accommodate itself to the larger irregularities of top surface 7, deforming into groove 12 as required for this purpose. Groove 12 has a rounded root to minimize the development of notch stresses in that portion of crown 1 when under tension load from high gas pressures.

Groove 12 also operates to enable the structure to better resist the effects of abnormal top-load pressure, which may be encountered when open-top cases containing the product are stacked several units high during storage. If no relief were provided under such conditions, ridge 11 might be deformed so severly as to prevent adequate recovery after removal of the excess load, thereby permitting greater subsequent leakage. However, the construction as disclosed herein allows ridge 11 to be deflected into the space of groove 12, thereby limiting its deformation and permitting the excess load to be shared by a larger portion of surface 13. The presence of seal 6 also reduces the concentration of pressure on ridge 11. As a result of all these factors, ridge 11 is less likely to be stressed beyond its compressive limit. It will then retain sufficient resilience to restore much, it not all, of its sealing efficiency after removal of the excess load, any gas pressure which leaks into space 15 will supplement this resealing action by increasing the pressure on the existing contact zone between the underside of seal 6 and surface 7.

The resistance of ridge 11 to permanent deformation may be still further improved by the addition of ridges 16 and 17. Since any top-load pressure applied to these ridges is transmitted primarily to those portions of surface 13 which are directly underneath, just inside of groove 12 and outside of ridge 11 respectively, and from there directly to seal 6 and surface 7, transient overloads are more widely distributed, and correspondingly less pressure is applied to ridge 11.

Figure 4:
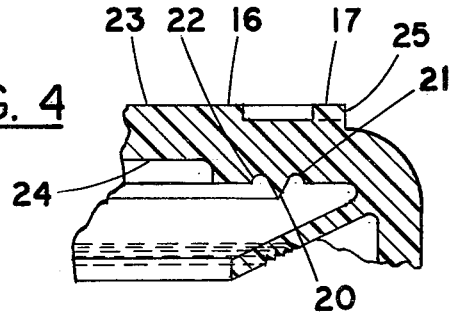
FIG. 4 is a partial sectional view of an upper portion of FIG. 1, showing alternative designs for the sealing ridge and closure crown.

FIG. 4 shows alternative constructions for the sealing ridge and for the central portion of the crown. In place of the assymmetrical combination of ridge 11 and groove 12, a symmetrical ridge 20, flanked by a pair of smaller grooves 21 and 22, may be preferred. For some applications the grooves may be omitted, and the ridge only used in the conventional way.

To further increase the resistance of the closure seals to top-load pressure, the inner portion of the crown may be offset upward until its upper surface 23 is substantially flush with the tops of ridges 16 and 17. The corresponding lower surface 24 may then be recessed enough to maintain the desired effective thickness of material. If desired, one or more slots 25 may be added to ridge 17 to drain off unwanted process or rainwater.

Since the internal gas pressure of carbonated beverages or other pressurized liquids normally causes the center of the closure to dome upward noticeably, any flattening of the dome is resisted by the gas pressure. This relieves some of the excess weight on the closure, which might otherwise result in excessive deformation of the sealing elements.

In compliance with the requirements of the patent statutes I have herein shown and described a preferred embodiment of the invention. It is, however, to be understood that the invention is not limited to the particular construction shown, the same being merely illustrative of the principles of the invention and its scope as determined by that of the claims.

What is claimed is:

1. A closure device molded of resilient material, for use with a container having an external screw thread about a cylindrical outlet and a rim perpendicular to said thread, comprising: a circular crown member, a cylindrical sidewall depending from said crown member and perpendicular to it, an internal screw thread within said sidewall to mate with said external thread, and multiple sealing means integral with the lower surface of said crown member for cooperation with said rim, said multiple sealing means comprising:

a first sealing means in the form of a ridge concentric with said sidewall and having a generally triangular cross-section, dependent from said crown member and having a crest diameter substantially equal to the mean diameter of said container rim:

a second sealing means in the form of a frusto-conical flexible flange dependent from the juncture of said crown member and said sidewall, and having an inner rim diameter substantially smaller than the diameter of said first sealing means:

said first sealing means comprising in addition to said ridge a circular groove directly inside of it, said ridge being asymmetrical and having its crest closely adjacent to said groove, the volume of said groove above the adjacent lower surface of said crown member being substantially equal to the volume of said sealing ridge below the same lower surface, said ridge volume being so related to the resilience of said molded material that when subjected to a normal axial working load said ridge will be substantially displaced into said groove.

2. A closure device as in claim 1, incorporating a third sealing means in the form of at least one circular ridge recessed into the lower surface of said flange with the crest of said ridge or ridges not projecting beyond said surface, and having a diameter after installation substantially equal to the effective diameter of said first sealing means, said circular ridge or ridges each having an effective volume not greater than one-third that of the ridge portion of said first sealing means; said ridge or ridges also being transversely connected to said lower surface and to each other by at least two radial ridges of the same height equally spaced around the circumference to form isolated sealing compartments.

3. A closure device as in claim 1, in combination with said container, in which the initial axial pitch of said internal screw thread is shorter than the initial axial pitch of said external screw thread, by an amount proportional to the difference in the effective elasticities of their respective component materials and to the pitch of said external thread.

4. A closure device molded of resilient material, for use with a container having an external screw thread about a cylindrical outlet and a rim perpendicular to said thread, comprising: a circular crown member, a cylindrical sidewall depending from said crown member and perpendicular to it, an internal screw thread within said sidewall to mate with said external thread, and sealing means integral with the lower surface of said crown member for cooperation with said rim, said sealing means comprising a concentric ridge of generally triangular cross-section, dependent from said crown member and having a crest diameter substantially equal to the mean diameter of said container rim;

a first overload-resistant means for said sealing means, in the form of a concentric ridge of generally rectangular cross-section and integral with the upper surface of said crown member, said ridge having an inside diameter not less than the maximum diameter of said sealing means, an outside diameter substantially equal to the outside diameter of said container rim, and a height above any adjacent portion of said upper surface of approximately one-third its radial width;

a second overload-resistant means for said sealing means, in the form of a concentric shoulder of generally rectangular contour and integral with the upper surface of said crown member, the edge of said shoulder having a diameter substantially equal to the minimum inside diameter of said sealing means, and substantially coplanar with the top surface of said first protective means.

* * * * *